United States Patent [19]

Denning

[11] 4,091,572

[45] May 30, 1978

[54] LAPIDARY SPHERE GRINDER

[76] Inventor: Gabriel J. Denning, 401 Chase, Wakeeney, Kans. 67672

[21] Appl. No.: 804,068

[22] Filed: Jun. 6, 1977

[51] Int. Cl.[2] ..... B24B 11/08

[52] U.S. Cl. ..... 51/103 R; 51/283 R; 51/289 S

[58] Field of Search ..... 51/103 R, 103 WH, 283, 51/289 S, 102; 125/10, 30 R

[56] References Cited

U.S. PATENT DOCUMENTS

| | | | |
|---|---|---|---|
| 1,399,687 | 12/1921 | Canda | 51/103 R |
| 1,791,713 | 2/1931 | Caster | 51/103 WH |
| 3,640,028 | 2/1972 | Richard | 51/289 S |

*Primary Examiner*—James L. Jones, Jr.
*Assistant Examiner*—Nicholas P. Godici

[57] ABSTRACT

A machine for grinding irregularly shaped rock, or various other material such as steel, wood, plastic or the like, into spherical shape; the machine including a table, upon which there is a motor driven grinding wheel and a motor driven, rubber tired wheel, the rock being maintained between a periphery of the rotating tired wheel and the grinding wheel surface, by means of a holder therebetween, that frames the rock, so it is confined to roll in the framed space, and not be able to escape therefrom, the tired wheel having an annular groove around its periphery, for seating the rock, and rolling the same, while the rubber tired wheel turns, the periphery of the rubber tired wheel, at one point, having a notch deeper than the peripheral groove, so as to interrupt the groove and, at this point, releasing the rock momentarily, so as to allow the rock to reset itself for a next rotation of the rubber tired wheel, so that, in time, the rock is rolled in all directions, and thus ground into a perfect sphere.

1 Claim, 5 Drawing Figures

LAPIDARY SPHERE GRINDER

This application is a substitute for Ser. No. 331,335 filed Feb. 9, 1973, now abandoned.

This invention relates generally to power driven grindstones, and, more particularly, to a sphere grinding machine.

A principal object of the present invention is to provide a sphere grinding machine, which will grind irregularly shaped rock, or various other material such as steel, wood, plastic or the like, into perfectly sphere shaped objects.

Another object of the present invention is to provide a sphere grinding machine, which incorporates a holding device, for retaining a rock between a rolling wheel and a grinding wheel, the holder not grasping the rock, but confining it within a working area, located between the rolling wheel and the grinding wheel.

Still another object is to provide a sphere grinding machine, in which a novel means is employed for resetting the rolling stone, so that the stone is rolled into all different directions, in order to be made spherical shaped, the novel means consisting of a notch on the periphery of the rolling wheel, so that the wheel momentarily releases its hold of the stone, thus allowing the stone to momentarily move, and thus reset itself, to turn in a different direction.

Other objects are to provide a sphere grinding machine, which is simple in design, inexpensive to manufacture, rugged in construction, easy to use and efficient in operation.

These, and other objects, will be readily evident upon a study of the following specification, and the accompanying drawing, wherein.

Figure 1:
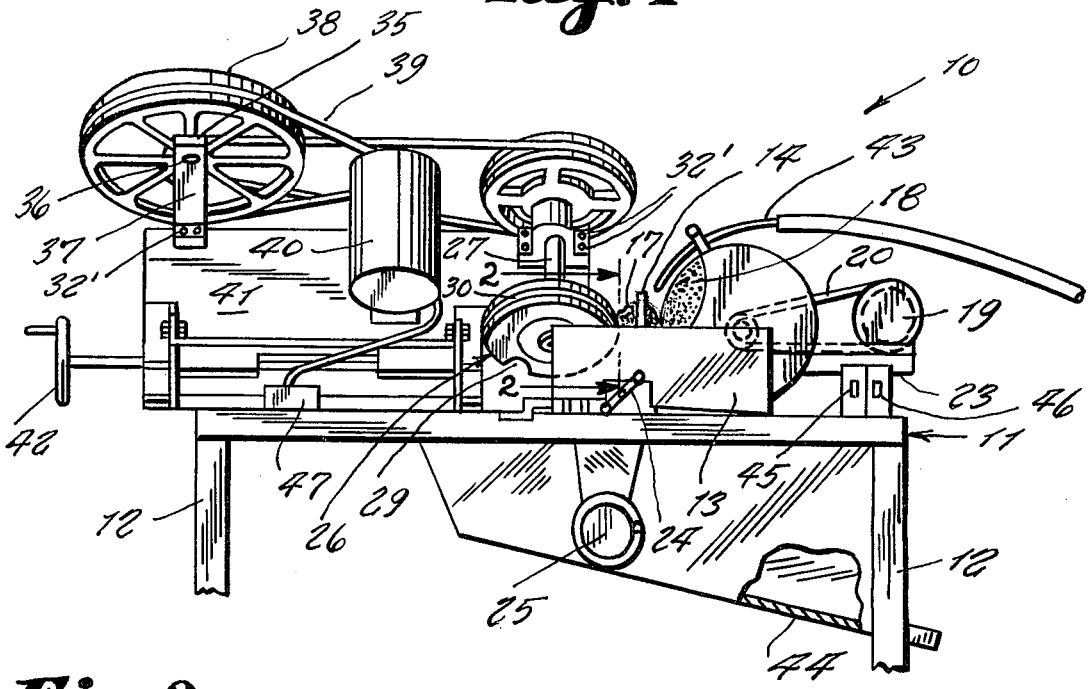
FIG. 1 is a side view of the present invention, shown in elevation, and partly broken away.
Figure 2:
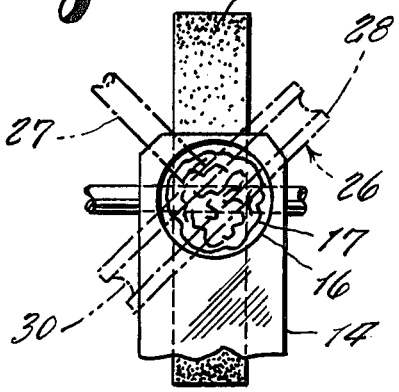
FIG. 2 is an enlarged view, taken along line 2—2 of FIG. 1.
Figure 5:
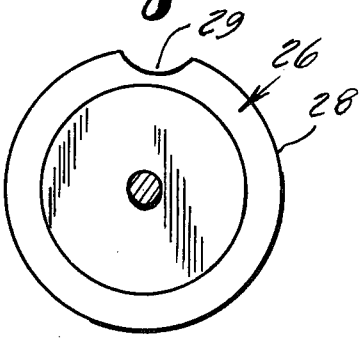
FIG. 5 is a view taken along line 5—5 of FIG. 4.
Figure 3:
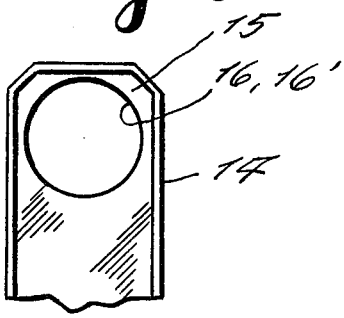
FIG. 3 is a rear view of the stone holder shown in FIG. 2.
Figure 4:
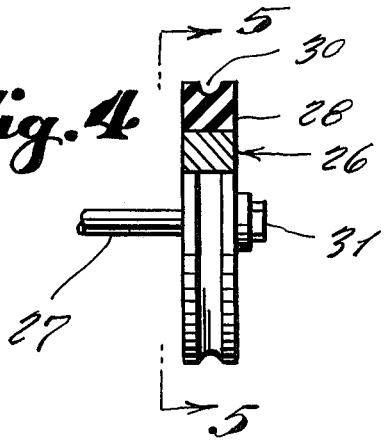
FIG. 4 is an enlarged view of the rubber tired wheel that is illustrated in phantom lines in FIG. 2, the wheel being shown in elevation, and partly broken away.

Referring now to the drawing in greater detail, a sphere grinding machine 10 is shown to include a table 11, having a leg 12 in each corner, two of which are shown. A slide member 13 is secured fixedly, in a suitable manner, to the rock holder 14, which is rimed to receive a removable insert 15. Insert 15 is of flat material, and may be made in different sizes, so as to accommodate various sized material. The opening 16, of insert 15, is circular in configuration, and aligns with the opening 16' of holder 14, so as to enable the stone 17 to be engaged with the outer periphery of the grinding stone 18.

It shall be noted that the stone 17, or other material to be ground, is first cubed, and cut off at the corners, prior to a grinding operation by means of machine 10.

Grindstone 18 is driven by means of electric motor 19, which is connected to grindstone 18, by way of an endless belt 20, carried around motor pulley 21 and driven pulley 22 of the grindstone 18.

The motor 19 is secured, in a well-known manner, to the base 23, which is supported upon table 11 by suitable support, not shown.

A crank 24 serves to move slide 13, and its associated holder 14, to and away from the grindstone 18 in a manner well-known in the art of lathes and other shop machines. A crank 25 is rotatably carried beneath the top of table 11, and serves to move the slide 13, and its associated holder 14, upwards and downwards, crank 25 being similar in construction to that of lathes, and other type shop machines also.

A metal wheel 26 is supported upon a shaft 27, at an angle above the table 11, the wheel 26 having a rubber tire 28, for frictional engagement with the stone 17 that is to be ground by the grinding stone 18. An annular groove 30 extends around the periphery of the rubber tired wheel 26, for serving as a seat for the stone rolling therein.

A semi-circular notch 29, in the periphery of tire 28, is deeper than the groove 30, and provides a means of momentarily releasing the rock or stone 17, so that the rock can reset itself upon each rotation of the wheel 26. When the notch meets the rock, the rock is thus freed, so as to bring up a new surface to be ground by the grinding stone 18.

The groove 30 forms a two-point contact with the stone 17.

The wheel 26 is secured fixedly to shaft 27, by means of a nut fastener 31, and shaft 27 is supported within pillow block 32, secured by a plurality of suitable fasteners 32'. A pulley 33, carried on the opposite end of shaft 27, receives endless belt 34, which is also carried on pulley 35, secured fixedly to shaft 36, in a suitable manner. Shaft 36 is supported in a bracket 37, and, also carried upon shaft 36, is a second pulley 38. An endless belt 39 carried on pulley 38, and a pulley, not shown, of motor 40, is secured in a suitable manner to an angularly positioned plate 41.

A crank 42 provides means of moving plate 41 horizontally above table 11, in a manner similar to that of lathes, and other shop machines, as heretofore described. The crank 42 will move the rubber tired wheel 26 to, and away from, the peripheral surface of stone 17, when so desired.

The shafts 27, 36 and the motor 40 are secured fixedly to the top of plate 41, by means of fasteners 32'. Drive arrangements of machine 10 may be modified, so as to be gear driven, rather than belt driven, as shown, if so preferred.

The motor 40 of machine 10 is a multi-speed type motor, so as to control the revolutions of the rubber tired wheel 26 against the stone surface.

It is to be noted, that the holder 14 serves to hold the work captive within a working area, between the rubber tired wheel and the grinding wheel, but the holder 14 does not physically grasp the work or rock. The work is free to rotate. The holder 14 is movable, upwardly and downwardly, by turning crank wheel 25. Two set screws, through the holder 14, hold in place the insert 15, which is merely a ring with a flange. The spacial relationship between the rubber tired wheel 26, holder 14 and grinder 18, is thus maintained. The wheel 26 is movable on a slide by turning the crank wheel 42, the slide having a travel of fourteen inches toward or away from the grinding wheel. The holder 14 is movable horizontally toward or away from the grinding wheel, by a crank, which is immediately below the member 14. The amount of work protruding through the insert is approximately one-half of the work diameter. In operation, the semi-circular opening notch 29 serves to reset the rock 17, upon each rotation of the wheel 26, and when the notch comes into alignment with the rock, the tire pressure is momentarily released, so that the rock is thus free to spin, or move, and thus bring up a new surface to be ground by the grinding stone.

When the stone 17 is being ground, a tube 43, secured above the grinding stone 18, provides lubrication means for the grinding operation, and an inclined chute 44 is fixedly secured to the under side of table 11, so as to enable the groundaway material of stone 17 to descend downwardly, and into a suitable receptacle, not shown, for catching the same.

The machine 10 includes a switch 46, mounted on the table 11, for controlling a coolant recirculating pump, not shown. The adjacent switch 46 provides an on and off switch means for the grinding stone motor 19, and a switch 47, secured to the table, provides control means for the multi-speed motor 40.

While various changes may be made in the detail construction, it is understood that such changes will be within the spirit and scope of the present invention, as is defined by the appended claims.

What I now claim is:

1. A sphere grinding machine, comprising, in combination, a table supported upon legs, a motor driven grindstone carried upon said table providing a means for grinding a surface of a stone for imparting a spherical shape thereto, a slide member with an insert-carrying stone holder carried by said table with crank means for moving said stone holder towards and away from said grinding wheel, an angularly positioned and shaft mounted rubber tired wheel carried on plate means above said table for intermittently rotating said stone being ground, pulley, belt, and motor means carried upon said plate, providing rotation means for said rubber tired wheel, crank means for moving said plate carrying said rubber tired wheel, a chute carried by said table providing gravity takeoff means for the ground away material of said stone, switch means on said table for controlling said motor driven grindstone and a coolant recirculating pump, said stone holder being rimed, and secured fixedly, to said slide member which holds said stone holder, and said stone holder receives a removable insert having an opening which aligns with an opening of said stone holder, said stone being presented and retained within said opening of said stone holder, against a peripheral edge of said grindstone, said crank means for moving said stone holder enabling said insert to be brought away from said grindstone as wished, said rubber tired wheel having an annular groove around its outer periphery forming a two-contact point surface against which said stone rolls, said wheel being secured to a shaft mounted to said plate means which is crank operated, so as to move said rubber tired wheel to and away from said stone being ground, said rubber tired wheel being secured fixedly to said shaft by a suitable nut fastener, said shaft being supported within block means secured fixedly to said table and said rubber tired wheel including a semicircular notch at one point on an outer periphery of said rubber tire, said notch when rotated into position for communication with said stone enabling said stone to be momentarily released and reset itself in another position against said rubber tired wheel resulting in an irregularly shaped stone being spherically ground.

* * * * *